US009347135B2

(12) United States Patent
Yamauchi et al.

(10) Patent No.: US 9,347,135 B2
(45) Date of Patent: May 24, 2016

(54) METHOD FOR RUST-PROOFING MOLD

(75) Inventors: Ikuo Yamauchi, Chiryu (JP); Yuichi Furukawa, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 35 days.

(21) Appl. No.: 14/350,967

(22) PCT Filed: Oct. 18, 2011

(86) PCT No.: PCT/JP2011/073937

§ 371 (c)(1),
(2), (4) Date: Apr. 10, 2014

(87) PCT Pub. No.: WO2013/057793

PCT Pub. Date: Apr. 25, 2013

(65) Prior Publication Data

US 2014/0287137 A1 Sep. 25, 2014

(51) Int. Cl.

| | |
|---|---|
| ***B22C 3/00*** | (2006.01) |
| ***C23C 22/74*** | (2006.01) |
| ***B22D 17/22*** | (2006.01) |
| ***C23C 26/00*** | (2006.01) |
| ***C23C 22/62*** | (2006.01) |
| ***C23C 22/68*** | (2006.01) |
| ***C23C 22/82*** | (2006.01) |
| ***C23C 8/04*** | (2006.01) |
| ***C23C 8/32*** | (2006.01) |
| *B22C 9/06* | (2006.01) |

(52) U.S. Cl.

CPC ..... *C23C 22/74* (2013.01); *B22C 9/061* (2013.01); *B22D 17/22* (2013.01); *C23C 8/04* (2013.01); *C23C 8/32* (2013.01); *C23C 22/62* (2013.01); *C23C 22/68* (2013.01); *C23C 22/82* (2013.01); *C23C 26/00* (2013.01); *B22C 3/00* (2013.01); *B22C 9/06* (2013.01)

(58) Field of Classification Search

CPC ..... B22C 3/00; B22C 9/06
USPC ..... 427/135
See application file for complete search history.

(56) References Cited

FOREIGN PATENT DOCUMENTS

| | | | | |
|---|---|---|---|---|
| JP | 49-31416 B1 | | 8/1974 | |
| JP | 9-268265 A | | 10/1997 | |
| JP | 2002-70873 A | | 3/2002 | |
| JP | 2007118035 | * | 11/2007 | ..... B22C 3/00 |
| JP | 2008105082 | * | 10/2008 | ..... B22C 9/06 |
| KR | 10-1998-066538 A | | 10/1998 | |

OTHER PUBLICATIONS

Solphilos, Rust Bluing—A tutorial, Jul. 2010, BushcraftUSA, http://bushcraftusa.com/forum/showthread.php/16456-Rust-bluing-A-tutorial.*

(Continued)

*Primary Examiner* — Andrew Bowman
(74) *Attorney, Agent, or Firm* — Oblon, McClelland, Maier & Neustadt, L.L.P.

(57) ABSTRACT

A method for rust-proofing a mold, which is capable of reducing the time and the cost required for rust-proofing the mold. The method includes an iron hydroxide-forming step for forming iron hydroxide on a predetermined part of the surface of the mold, and a surface-treating step for forming a film covering the molding surface of the mold, and for changing the iron hydroxide formed on the mold into black rust, by heating the mold, under an oxygen-deficiency atmosphere, on which the iron hydroxide is formed in the iron hydroxide-forming step.

5 Claims, 2 Drawing Sheets

(56) References Cited

OTHER PUBLICATIONS

Ledvon et al., Seamless Process Creates the Impossible Cooling Channel, Apr. 2011, Plastics Technology, http://www.ptonline.com/articles/seamless-process-creates-the-impossible-cooling-channel.*

Unknown, Degasification, 2005, Wikipedia, https://en.wikipedia.org/wiki/Degasification.*

Canter S., "Black Rust" and Cast Iron Seasoning, Feb. 2010, Sheryl's Blog, http://sherylcanter.com/wordpress/2010/02/black-rust-and-cast-iron-seasoning/comment-pages.*

* cited by examiner

METHOD FOR RUST-PROOFING MOLD

TECHNICAL FIELD

The present invention relates to a method for rust-proofing a mold.

BACKGROUND ART

Conventionally, a technique is publicly known by which a treatment (rust-proof treatment) for preventing formation of what is called red rust ($Fe_2O_3$) is applied to a mold used in die casting and the like.

Patent Literature 1 discloses a coating composition for metal, which consists primarily of Zn—Al alloy powder and water-soluble chromium compound.

The coating composition disclosed in Patent Literature 1 is applied to the surface of a metal, and then is heated for a predetermined time at a predetermined temperature, thereby changing into a rust-proof film. The rust-proof film prevents the red rust from forming on the metal.

In the case of applying the coating composition disclosed in Patent Literature 1 to a mold used in die casting and the like, the rust-proof film is formed on a surface other than the molding surface of the mold (in particular, the surface of the cooling channel on which the red rust is easy to form) because a film (for example, a carbon film) for accomplishing reduction of mold-release resistance and the like is formed on the molding surface of the mold.

In this case, it is disadvantageous in that a step for forming the rust-proof film on the surface other than the molding surface of the mold must be performed, in addition to a step for forming the film such as the carbon film on the molding surface of the mold.

Moreover, when the mold is put in a heating furnace in order to repair the film such as the carbon film formed on the molding surface of the mold, materials constituting the rust-proof film may be scattered, which may have a negative influence on forming the film on the molding surface of the mold. Therefore, it is disadvantageous in that the rust-proof film must be removed when the film such as the carbon film formed on the molding surface of the mold is repaired.

Thus, a conventional rust-proof treatment on the mold causes an increase in time and cost required for rust-proofing the mold.

CITATION LIST

Patent Literature

Patent Literature 1: JP H9-268265 A

SUMMARY OF INVENTION

Problem to be Solved by the Invention

The objective of the present invention is to provide a method for rust-proofing a mold, which is capable of reducing the time and the cost required for rust-proofing the mold.

Means for Solving the Problem

A first aspect of the invention is a method for rust-proofing a mold having a molding surface, which includes an iron hydroxide-forming step for forming iron hydroxide on a predetermined part of a surface of the mold, and a surface-treating step for forming a film covering the molding surface of the mold, and for changing the iron hydroxide formed on the mold into black rust, by heating the mold, under an oxygen-deficiency atmosphere, on which the iron hydroxide is formed in the iron hydroxide-forming step.

Preferably, in the iron hydroxide-forming step, a black-rust accelerant containing water and a material with reducibility is applied to the predetermined part of the surface of the mold.

Preferably, the mold has at least one cooling channel through which cooling water flows, the cooling channel being bored from a surface other than the molding surface of the mold toward the inside of the mold, and in the iron hydroxide-forming step, the iron hydroxide is formed on the whole surface of the cooling channel.

More preferably, the iron hydroxide-forming step is a step for performing a water-flow test of the cooling channel.

Advantageously, the film covering the molding surface of the mold is a carbon film.

More advantageously, in the surface-treating step, an inert gas is supplied from a side on which the molding surface of the mold is situated.

Effects of the Invention

The present invention makes it possible to reduce the time and the cost required for rust-proofing the mold.

DESCRIPTION OF EMBODIMENTS

[First Embodiment]

Figure 1:
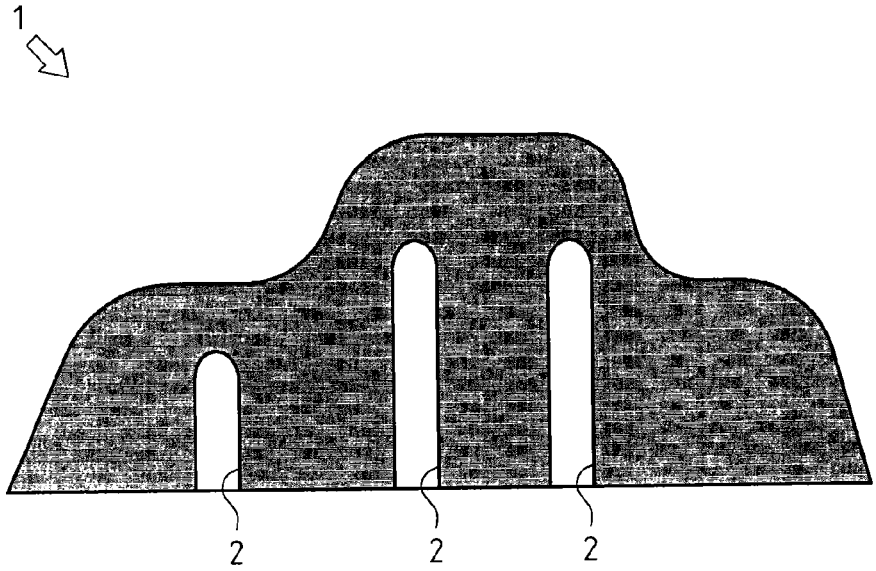
FIG. 1 illustrates a mold according to an embodiment of the present invention.
Figure 2:
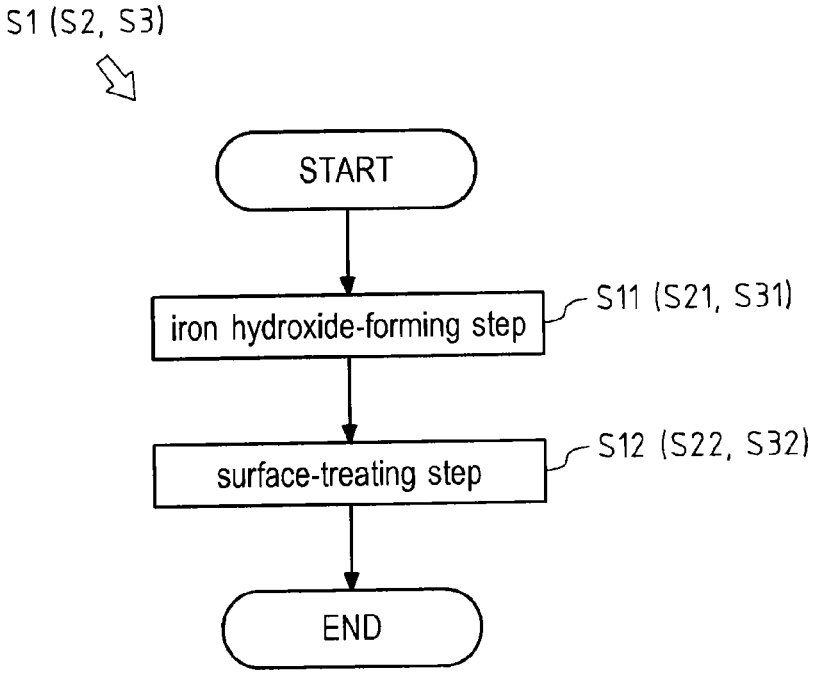
FIG. 2 shows a step for rust-proofing the mold according to an embodiment of the present invention.
Figure 3:
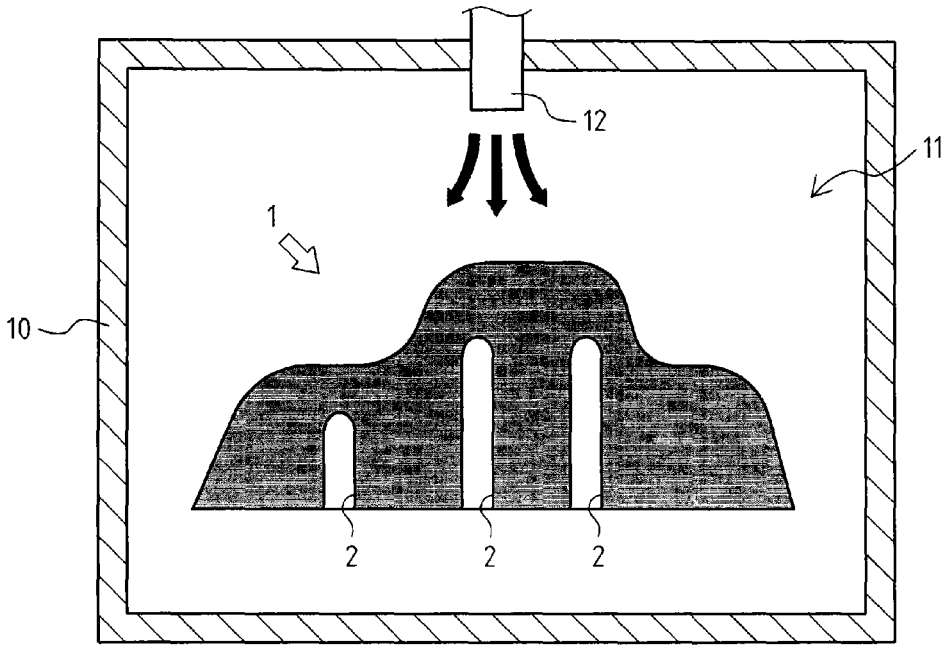
FIG. 3 illustrates a treating furnace used in a surface-treating step.

With reference to FIGS. 1 to 3, described below is a step S1 for rust-proofing a mold 1 as a first embodiment of a method for rust-proofing a mold according to the present invention.

The step S1 is a step for applying a treatment (rust-proof treatment) for preventing formation of what is called red rust ($Fe_2O_3$) to the mold 1. In the step S1, a film of what is called black rust ($Fe_3O_4$) is formed on a predetermined part of the surface of the mold 1 to prevent the red rust from forming on the predetermined part.

The mold 1 is used in die casting and the like, and is made of a predetermined steel material (e.g. SKD61).

As shown in FIG. 1, the mold 1 has a molding surface with a predetermined shape, which is formed on the upper surface (upper surface in FIG. 1) of the mold 1. On the surface (lower surface in FIG. 1) opposite to the molding surface of the mold 1, a plurality of cooling channels 2 are formed toward the inside of the mold 1.

The plurality of cooling channels 2 are passages through which cooling water for cooling the mold 1 flows, and are formed inside the mold 1. The plurality of cooling channels 2 are bored from the surface (surface other than the molding surface) opposite to the molding surface of the mold 1 toward the inside of the mold 1, and are extended in various directions inside the mold 1.

As shown in FIG. 2, the step S1 includes an iron hydroxide-forming step S11 and a surface-treating step S12.

The iron hydroxide-forming step S11 is a step for forming iron hydroxide on the whole surface of the plurality of cooling channels 2 in the mold 1.

"A surface of the mold" according to the present invention includes the surface of a cooling channel formed inside the mold. The whole surface of the plurality of cooling channels 2 in the present embodiment is an embodiment of "a predetermined part of a surface of the mold" according to the present invention.

In the iron hydroxide-forming step S11, a black-rust accelerant is applied to the whole surface of all the cooling channels 2.

The "black-rust accelerant" according to the present invention is a liquid containing water and a material with reducibility.

A release agent disclosed in JP 2007-118035 A may be adopted as the black-rust accelerant. The release agent is a water-soluble agent containing an organic acid with reducibility, or an organic acid salt.

In the iron hydroxide-forming step S11, the mold 1 in which the black-rust accelerant is applied to the whole surface of the cooling channels 2 is allowed to stand for a predetermined time under an oxidizing atmosphere (e.g. air atmosphere).

When the predetermined time elapses under the oxidizing atmosphere (e.g. air atmosphere) after applying the black-rust accelerant to the whole surface of the cooling channels 2 of the mold 1, the iron hydroxide is formed on the whole surface of the cooling channels 2 by the water present in the black-rust accelerant.

The "iron hydroxide" according to the present invention includes iron(II) hydroxide ($Fe(OH)_2$) and iron(III) hydroxide ($Fe(OH)_3$).

The surface-treating step S12 is a step for forming a carbon film on the molding surface of the mold 1, and for changing the iron hydroxide formed on the whole surface of the cooling channels 2 of the mold 1 into the black rust, by heating the mold 1, under an oxygen-deficiency atmosphere, in which the iron hydroxide is formed on the whole surface of the cooling channels 2 in the iron hydroxide-forming step S11.

The "oxygen-deficiency atmosphere" according to the present invention includes an atmosphere in which a tiny amount of oxygen exists, and an atmosphere (non-oxidizing atmosphere) in which no oxygen exists. For example, the oxygen-deficiency atmosphere is an atmosphere in which an oxygen concentration is equal to or smaller than 5% in the air, or equal to or smaller than 1 ppm in the water.

The carbon film is an embodiment of "a film covering the molding surface of the mold" according to the present invention, and is a film for reducing mold-release resistance, for preventing the molding surface of the mold from melting, and the like.

In the surface-treating step S12, the mold 1 in which the iron hydroxide is formed on the whole surface of the cooling channels 2 is heated under the oxygen-deficiency atmosphere by a treating furnace 10.

As shown in FIG. 3, the treating furnace 10 has a treating room 11 thereinside which is an airtight space where the mold 1 is placed. The treating furnace 10 is configured to supply a predetermined gas to the treating room 11 through a supply port 12, and to raise a temperature of the treating room 11 to a desired temperature.

The supply port 12 supplies the predetermined gas to the treating room 11. The supply port 12 is arranged in the upper part (upper part in FIG. 3) of the treating room 11. The gas in the treating room 11 is discharged by a pump through a discharge port (not shown) arranged in a part (lower part in FIG. 3) opposite to the supply port 12 of the treating room 11.

Before heating the mold 1 in which the iron hydroxide is formed on the whole surface of the cooling channels 2 in the treating furnace 10, masking is applied to a predetermined part of the surface of the mold 1. The masking prevents the treatment (formation of the carbon film) to be applied to the molding surface of the mold 1 from having an influence on a surface other than the molding surface of the mold 1.

In the present embodiment, after filling the openings of the cooling channels 2 on the surface (lower surface in FIG. 3) opposite to the molding surface of the mold 1 with suitable filling members, a chemical agent such as an anti-nitriding agent is applied to the surface other than the molding surface of the mold 1, thereby the masking being applied to the surface.

After applying the masking to the mold 1, the filling members are removed. Then, the mold 1 is put in the treating room 11 of the treating furnace 10, and is placed on a netted stand (not shown) or the like so that the molding surface of the mold 1 faces the supply port 12 (faces upward).

After placing the mold 1 in the treating room 11, an inert gas such as nitrogen ($N_2$) is gradually supplied to the treating room 11 being in the air atmosphere from the supply port 12 to gradually reduce an amount of oxygen in the treating room 11. After a predetermined time elapses while supplying the inert gas to the treating room 11, the temperature of the treating room 11 is gradually raised. In the process for raising the temperature of the treating room 11, supply of the inert gas is controlled so that the treating room 11 is in the non-oxidizing atmosphere, namely, the atmosphere in which no oxygen exists before the temperature of the treating room 11 reaches a temperature (approximately 250° C.) at which the black rust begins to form.

After the temperature of the treating room 11 reaches a predetermined temperature (e.g. 500° C.), the mold 1 is heated for a predetermined time (e.g. 3 hours) while maintaining the temperature.

After heating the mold 1, the mold 1 is taken out from the treating furnace 10 to remove the masking applied to the mold 1.

In the process for raising the temperature of the treating room 11 to heat the mold 1, reactive gasses such as acetylene ($C_2H_2$) and ammonia ($NH_3$) are suitably supplied to the treating room 11 in order to form the carbon film on the molding surface of the mold 1.

Thus, in the surface-treating step S12, the inert gas such as nitrogen is gradually supplied to the treating room 11, and thereby the treating room 11 is in the oxygen-deficiency atmosphere.

The mold 1 is heated with the reactive gasses under the oxygen-deficiency atmosphere, and thereby the carbon film is formed on the molding surface of the mold 1.

Moreover, the mold 1 is heated under the oxygen-deficiency atmosphere, and thereby the iron hydroxide formed on the whole surface of the cooling channels 2 is changed into the black rust.

At this time, the material with reducibility present in the black-rust accelerant reduces the iron hydroxide, and thereby the formation of the black rust is accelerated.

Thus, a film of the black rust is formed so as to cover the whole surface of the cooling channels 2 of the mold 1.

Since the black rust formed on the whole surface of the cooling channels 2 of the mold 1 is a film with dense structure, the black rust prevents the cooling water flowing through the cooling channels 2 during the casting from corroding the mold 1. In other words, the black rust covering the whole surface of the cooling channels 2 of the mold 1 enables the whole surface thereof to have a rust-proof property.

Since the black rust can be formed at approximately 250° C. or more under the oxygen-deficiency atmosphere, the mold 1 is heated at 250° C. or more by the treating furnace 10.

In the present embodiment, in the process for raising the temperature of the treating room 11, the supply of the inert gas is controlled so that the treating room 11 is in the non-oxidizing atmosphere before the temperature of the treating room 11 reaches the temperature (approximately 250° C.) at which the black rust begins to form, but the temperature of the treating room 11 may be raised after the treating room 11 is in the non-oxidizing atmosphere. However, it is preferable that, as in the present embodiment, the supply of the inert gas is controlled so that the treating room 11 is in the non-oxidizing atmosphere before the temperature of the treating room 11 reaches the temperature (approximately 250° C.) at which the black rust begins to form because the black rust is easy to form under an atmosphere in which a small amount of oxygen exists.

As mentioned above, by heating the mold 1 in which the iron hydroxide is formed on the whole surface of the cooling channels 2 under the oxygen-deficiency atmosphere, the carbon film is formed on the molding surface of the mold 1, and the iron hydroxide formed on the whole surface of the cooling channels 2 of the mold 1 is changed into the black rust.

Thus, if the step S1 is performed, a step for rust-proofing the whole surface of the cooling channels 2 of the mold 1 need not be performed in addition to a step for forming the carbon film on the molding surface of the mold 1.

This makes it possible to reduce the time and the cost required for rust-proofing the mold 1.

In the present embodiment, the mold 1 is arranged in the treating room 11 of the treating furnace 10 so that the molding surface of the mold 1 faces the supply port 12 (faces upward).

Therefore, the inert gas supplied from the supply port 12 arrives in a space of the treating room 11 to which the molding surface of the mold 1 faces before arriving in a space (space below the mold 1 in FIG. 3) of the treating room 11 to which the surface opposite to the molding surface of the mold 1 faces. In other words, since the inert gas is supplied from the side on which the molding surface of the mold 1 is situated, the space of the treating room 11 to which the molding surface of the mold 1 faces becomes an atmosphere in which a large amount of inert gas exists earlier than the space of the treating room 11 to which the surface opposite to the molding surface of the mold 1 faces.

The carbon film is formed on the molding surface of the mold 1 by heating the mold 1 with the reactive gasses under the oxygen-deficiency atmosphere. However, it is preferable that the carbon film is formed under the non-oxidizing atmosphere, namely, the atmosphere in which no oxygen exists.

On the other hand, since the black rust is easy to form under the atmosphere in which a small amount of oxygen exists as mentioned previously, it is preferable that the black rust is formed under the atmosphere in which a tiny amount of oxygen exists.

The mold 1 is heated in conditions where the molding surface on which the carbon film is to be formed is arranged in the space which is relatively early to be in the atmosphere in which a large amount of inert gas exists, and where the surface (lower surface in FIG. 3) on which the cooling channels 2 where the black rust is to be formed opens is arranged in the space which is relatively late to be in the atmosphere in which a large amount of inert gas exists, thus enabling to efficiently form the carbon film and the black rust.

In the present embodiment, the treating furnace 10 having the supply port 12 arranged in the upper part (upper part in FIG. 3) of the treating room 11 is used. However, the treating furnace 10 having the supply port 12 arranged in another part may be used.

For example, if the treating furnace 10 having the supply port 12 arranged in the lower part (lower part in FIG. 3) of the treating room 11 is used, the mold 1 may be placed in the treating room 11 so that the molding surface of the mold 1 faces downward.

The mold 1 in which the black rust is formed on the whole surface of the cooling channels 2 can maintain the black rust in the process for running the cooling water through the cooling channels 2 during the casting.

Specifically, adding the black-rust accelerant to the cooling water enables the whole surface of the cooling channels 2 with which the cooling water comes in contact to be under an environment where the black rust can form, and enables the black rust to keep the same condition during the casting.

This makes it possible to, even if the black rust is cracked by expansion and contraction of the mold 1 caused by heat of molten metal and the like during the casting, repair the cracked black rust without the cooling water arrived on the newly-formed surface from the crack of the black rust producing the red rust on the mold 1.

Therefore, it is possible to reduce maintenance frequency of the mold 1, and cost required for the casting.

In the present embodiment, the carbon film is formed on the molding surface of the mold 1, but a film formed on the molding surface of the mold is not limited thereto.

The present invention may be applied in the case of forming various kinds of films by changing the time and the temperature for heating the mold, and the reactive gases depending on the kind of the film.

[Second Embodiment]

With reference to FIG. 2, described below is a step S2 for rust-proofing the mold 1 as a second embodiment of a method for rust-proofing a mold according to the present invention.

As shown in FIG. 2, the step S2 includes an iron hydroxide-forming step S21 and a surface-treating step S22.

The iron hydroxide-forming step S21 is a step for forming the iron hydroxide on the whole surface of the plurality of cooling channels 2 in the mold 1.

In the iron hydroxide-forming step S21, after running the cooling water through all the cooling channels 2 for a predetermined time, the mold 1 is allowed to stand for a predetermined time under the oxidizing atmosphere (e.g. air atmosphere).

Consequently, the iron hydroxide is formed on the whole surface of the cooling channels 2 by the cooling water attached on the whole surface of the cooling channels 2.

The operation for running the cooling water through the cooling channels 2 in the iron hydroxide-forming step S21 may be performed as an operation (what is called a water-flow test) for checking whether the cooling channels 2 are formed so that the cooling water flows therethrough.

The water-flow test is indispensably performed for using the mold 1 in the casting. Therefore, the water-flow test of the cooling channels 2 is performed as the iron hydroxide-forming step S21, thus enabling to reduce the time required for a series of operations using the mold 1.

The surface-treating step S22 is a step for forming the carbon film on the molding surface of the mold 1, and for changing the iron hydroxide formed on the whole surface of the cooling channels 2 of the mold 1 into the black rust, by heating the mold 1, under the oxygen-deficiency atmosphere, in which the iron hydroxide is formed on the whole surface of the cooling channels 2 in the iron hydroxide-forming step S21.

In the surface-treating step S22, the mold 1 in which the iron hydroxide is formed on the whole surface of the cooling channels 2 is heated by a treating furnace 10 as in the surface-treating step S12 of the step S1.

Since the surface-treating step S22 is substantially similar to the surface-treating step S12, the detailed description for the surface-treating step S22 is omitted.

[Third Embodiment]

With reference to FIG. 2, described below is a step S3 for rust-proofing the mold 1 as a third embodiment of a method for rust-proofing a mold according to the present invention.

As shown in FIG. 2, the step S3 includes an iron hydroxide-forming step S31 and a surface-treating step S32.

The iron hydroxide-forming step S31 is a step for forming the iron hydroxide on the whole surface of the mold 1 including the surface of the plurality of cooling channels 2 in the mold 1.

The whole surface of the mold 1 in the present embodiment is an embodiment of "a predetermined part of a surface of the mold" according to the present invention.

In the iron hydroxide-forming step S31, after applying atomized water to the whole surface of the mold 1, the mold 1 is allowed to stand for a predetermined time under the oxidizing atmosphere (e.g. air atmosphere).

Consequently, the iron hydroxide is formed on the whole surface of the mold 1 by the water attached on the whole surface of the mold 1.

The black-rust accelerant may be added to the water to be applied to the whole surface of the mold 1, or the black-rust accelerant may be applied to the whole surface of the mold 1 instead of the water.

The surface-treating step S32 is a step for changing the iron hydroxide formed on the whole surface of the mold 1 into the black rust by heating the mold 1, under the oxygen-deficiency atmosphere, in which the iron hydroxide is formed on the whole surface thereof in the iron hydroxide-forming step S31.

In the surface-treating step S32, a tempering treatment for removing stress is applied to the mold 1.

The tempering treatment of the mold 1 is an operation for removing residual stress in the mold 1 by heating the mold 1 for a predetermined time (e.g. 4 hours) at a predetermined temperature (e.g. 500° C.) under the oxygen-deficiency atmosphere.

The mold 1 is heated under the oxygen-deficiency atmosphere during the tempering treatment. Thereby, the iron hydroxide formed on the whole surface of the mold 1 is changed into the black rust, and the film of the black rust is formed so as to cover the whole surface of the mold 1.

Thus, in the surface-treating step S32, the tempering treatment is applied to the mold 1, and at the same time, the black rust is formed on the whole surface of the mold 1, thus enabling to reduce the time required for a series of operations using the mold 1.

As mentioned above, the film of the black rust covering the whole surface of the mold 1 is formed through the step S3.

Since the black rust formed on the whole surface of the mold 1 is a film with dense structure, the part of the black rust formed on the molding surface of the mold 1 acts, similarly to the carbon film, as a film for reducing mold-release resistance, for preventing the molding surface of the mold from melting, and the like. On the other hand, the part of the black rust formed on the surfaces of the cooling channels 2 prevents the cooling water from corroding the mold 1.

Thus, if the step S3 is performed, a step for rust-proofing the whole surface of the cooling channels 2 of the mold 1 need not be performed in addition to a step for forming the film for reducing mold-release resistance and the like on the molding surface of the mold 1.

This makes it possible to reduce the time and the cost required for rust-proofing the mold 1.

INDUSTRIAL APPLICABILITY

The present invention is applied to a method for rust-proofing a mold in which a film for accomplishing reduction of mold-release resistance and the like is formed on the molding surface of the mold.

REFERENCE SIGNS LIST

1: mold
2: cooling channel
10: treating furnace
11: treating room
12: supply port

The invention claimed is:

1. A method for rust-proofing a mold having a molding surface and at least one cooling channel through which cooling water flows, the cooling channel being bored from a surface other than the molding surface of the mold toward an inside of the mold, comprising:

an iron hydroxide-forming step for forming iron hydroxide on a whole surface of the at least one cooling channel; and a surface-treating step for forming a film covering the molding surface of the mold and for changing the iron hydroxide formed on the whole surface of the at least one cooling channel into black rust, by heating the mold on which the iron hydroxide is formed in the iron hydroxide-forming step under an oxygen-deficiency atmosphere containing an inert gas and a reactive gas for forming the film.

2. The method according to claim 1, wherein in the iron hydroxide-forming step, a black-rust accelerant containing water and a material with reducibility is applied to the whole surface of the at least one cooling channel.

3. The method according to claim 1, wherein the iron hydroxide-forming step is a step for performing a water-flow test of the cooling channel.

4. The method according to claim 1, wherein the film covering the molding surface of the mold is a carbon film.

5. The method according to claim 4, wherein in the surface-treating step, the inert gas is supplied from a side on which the molding surface of the mold is situated.

* * * * *